United States Patent [19]

Paulin

[11] 4,111,297

[45] Sep. 5, 1978

[54] CARTRIDGE FOR HARDWARE PACKAGES

[76] Inventor: Arthur Paulin, 7 High Point Rd., Don Mills, Canada, M2B 2A3

[21] Appl. No.: 817,933

[22] Filed: Jul. 22, 1977

[51] Int. Cl.[2] ..... B65D 23/12

[52] U.S. Cl. ..... 206/44.12; 206/606; 206/628; 206/806

[58] Field of Search ..... 206/607, 628, 611, 612, 206/806, 45.12, 44.12, 606; 221/312 R, 312 C

[56] References Cited

U.S. PATENT DOCUMENTS

| | | | |
|---|---|---|---|
| 2,547,892 | 4/1951 | Stevens | 206/628 |
| 2,832,504 | 4/1958 | Foster | 206/628 |
| 3,148,770 | 9/1964 | Cosman | 206/806 |
| 3,458,109 | 7/1969 | Compton et al. | 206/628 |
| 3,690,544 | 9/1972 | Meyers | 206/607 |
| 3,788,540 | 1/1974 | Sammons | 206/633 |
| 3,853,261 | 12/1974 | Moore | 206/607 |
| 3,952,872 | 4/1976 | Consiglio, Jr. | 206/806 |

FOREIGN PATENT DOCUMENTS

| | | | |
|---|---|---|---|
| 969,140 | 6/1975 | Canada | 206/806 |
| 474,648 | 11/1937 | United Kingdom | 206/607 |

*Primary Examiner*—William Price
*Assistant Examiner*—Joseph Man-Fu Moy
*Attorney, Agent, or Firm*—Rogers, Bereskin & Parr

[57] ABSTRACT

A cartridge is described for use in loading onto display racks, packages of hardware and like articles. The cartridge includes a disposable carton containing a plurality of such packages. A tear-strip is provided in one wall of the carton and is removable to expose the packages for individual pricing. After removal of the tear-strip, a top portion of the carton can be folded back to expose the tops of the packages so that they can be loaded seriatim onto a suspension element of a display rack.

7 Claims, 4 Drawing Figures

CARTRIDGE FOR HARDWARE PACKAGES

This invention relates generally to the merchandising of hardware and like articles in packages.

It is conventional merchandising practice to offer for sale small numbers of hardware articles in prepackaged form. A package typically comprises a plastic container having a hanging tab by which the package can be suspended from a display rack in a store, and a number of, say, nuts or bolts of the same size disposed in the container. An example of a package of this kind is disclosed in Canadian Pat. No. 265,505 filed Nov. 12, 1976 and entitled CONTAINER.

Display racks for packages of hardware and like articles may take many forms. In one simple type, the rack comprises a self-standing support structure carrying fixed package suspension elements in the form of hooks from which the packages hang. The structure may be turnable so that packages can be carried on all sides. In another type of display rack, the suspension elements may be in the form of bars which project outwardly from a support. An example of a rack of this general type is disclosed in Canadian Pat. No. 270,405 filed Jan. 25, 1977, and entitled DISPLAY RACK. In any event, the racks are designed so that a customer can inspect the packages and remove selected packages from the rack suspension elements. As the supply of packages on particular suspension elements becomes low, store personnel re-stock the rack by loading new packages individually onto appropriate ones of the suspension elements. It will be appreciated that this is a time consuming and somewhat tedious operation. Also, care must be taken to ensure that packages containing similar items are grouped together on the rack.

An object of the present invention is to provide improvements designed to facilitate the operation of loading onto display racks, packages of hardware and like articles.

According to the invention, there is provided a cartridge comprising a carton and a plurality of similar packages of hardware and like articles disposed in said carton. Each package comprises a container having a hanging tab which is formed with an opening and by which the container can be suspended from a suspension element of a display rack in use. The carton includes front and rear walls, opposite end walls, and top and bottom walls which together define an enclosure. The packages are arranged in a row in the enclosure with the openings in their hanging tabs aligned with one another and with said end walls of the carton. The front wall of the carton is formed with respective upper and lower rows of perforations which extend from end to end of said wall and which define a removable tear-strip. Each end wall of the carton is perforated to allow an upper portion of the carton to be folded back about a line extending transversely of the back wall after removal of said tear-strip, thereby exposing the handling tabs of the packages in the carton and permitting the packages to be loaded seriatim as a batch onto a suspension element of a display rack.

According to a further aspect of the invention, there is provided a carton per se of the form defined above. A still further aspect of the invention provides a blank for forming a carton of generally rectangular box form having front, rear, top, bottom and opposite end walls and intended to receive a plurality of similar packages of hardware and like articles. The blank defines a plurality of adjoining panels which are foldable with respect to one another in assembling the carton. A first of these panels defines the front wall of the assembled carton, and second and third ones of the panels define the end walls of the assembled carton and are coupled to respectively opposite ends of the first panel at fold lines. The first panel has upper and lower edges which extend generally normal to the fold lines and which are disposed adjacent the top and bottom walls respectively in the assembled carton. The first panel is formed with upper and lower lines of perforations which extend from end to end thereof in spaced positions and which define a removable tear-strip, and the second and third panels are perforated along lines which extend transversely thereof and which are aligned with said upper line of perforations in the first panel.

In order that the invention may be more clearly understood, reference will now be made to the accompanying drawings which illustrate a preferred embodiment of the invention, and in which.

Figure 1:
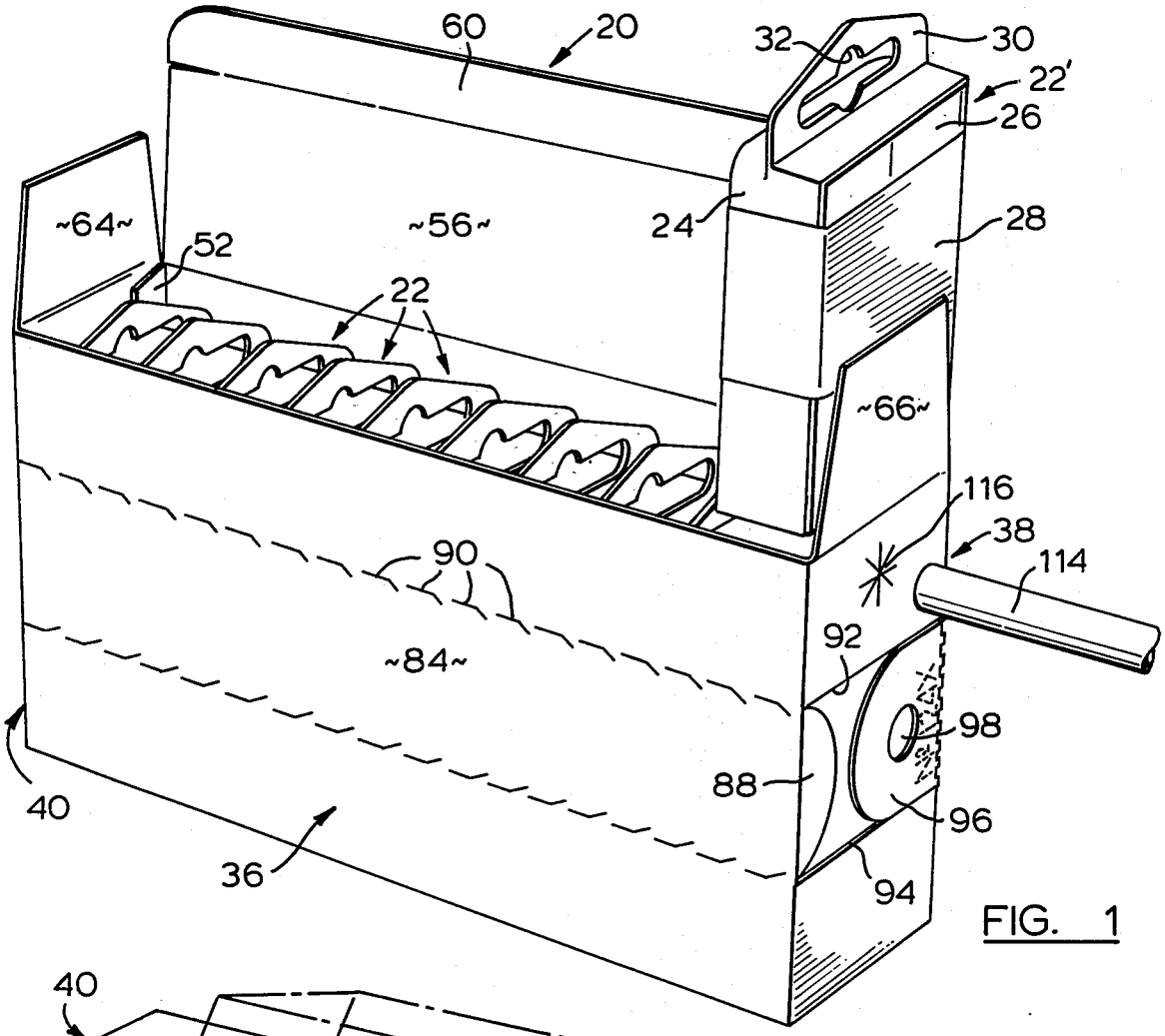
FIG. 1 is a partly exploded perspective view of a cartridge according to the invention.

Referring first to FIG. 1, the cartridge includes a cardboard carton 20 and a plurality of similar packages 22 of hardware articles disposed in the carton. One of these packages is shown in an elevated position above the carton and is denoted 22'. The package are of the form disclosed in Canadian Pat. No. 265,505. For present purposes, it is sufficient to note that each package is in the form of a plastic box 24 (see package 22') having a lid 26 which is slidably removable but which is normally held in place by a label 28 adhered both to the lid and to the sides of the box. The box is formed with an integral hanging tab 30 having an opening 32 to receive a suspension element of a display rack. A typical suspension element is indicated at 34 in FIGS. 2 and 3, which Figures will be more specifically discussed later.

Figure 4:
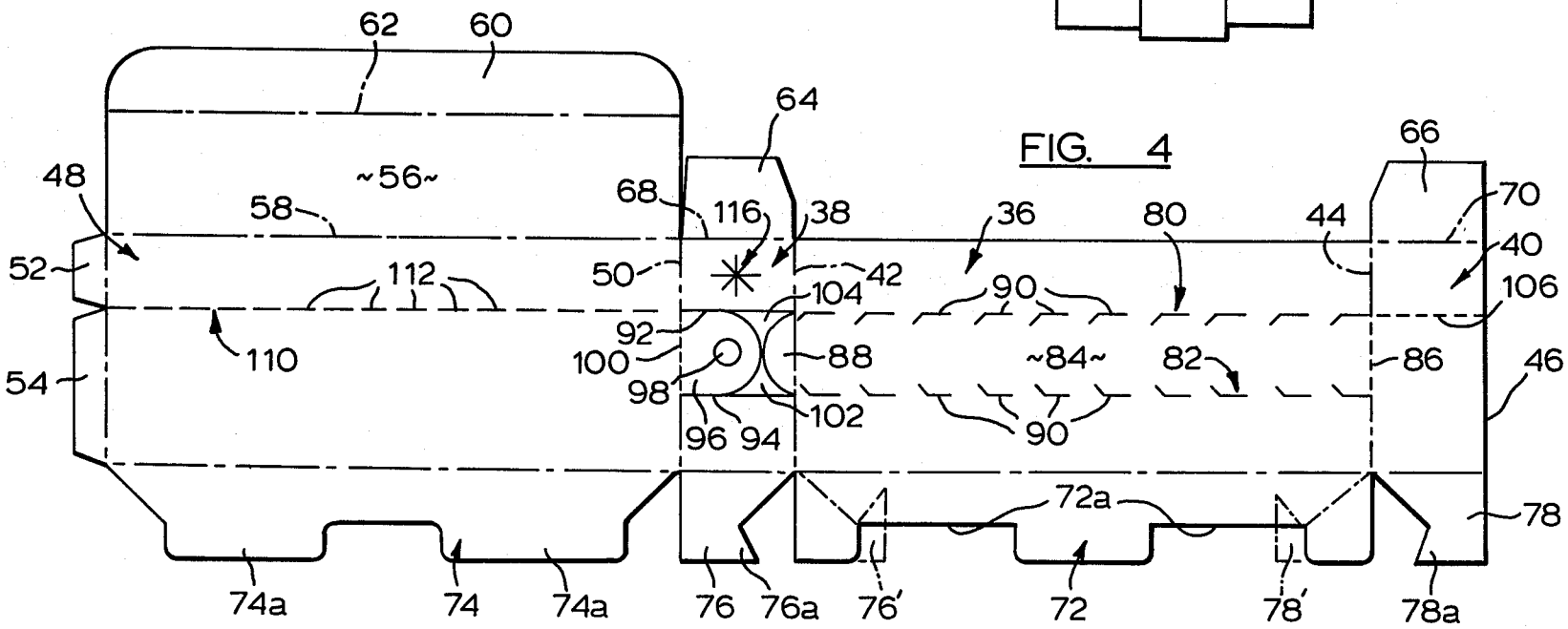

Carton 20 is of generally rectangular box form and is assembled from a cardboard blank of the shape shown in FIG. 4. The surface of the blank which is visible in FIG. 4 forms the inner surface of the assembled carton. The blank includes a plurality of adjoining panels which are foldable with respect to one another. Fold lines between adjacent panels are shown by chain dotted lines. A first rectangular panel 36 of the blank defines a front wall of the carton. Second and third rectangular panels 38 and 40 respectively define end walls of the carton and adjoin panel 36 at fold lines 42 and 44 respectively. It will be seen that the panels 38 and 40 are of the same height as panel 36, but of a narrower width corresponding generally to the width of the packages 22. Panel 40 terminates in an outer edge 46 at one end of the blank, while panel 38 adjoins an end of a further rectangular panel 48 which defines a rear wall of the carton. A fold line between panels 38 and 48 is denoted 50. At its end opposite panel 38, panel 48 is provided with tabs 52 and 54. In assembling the carton, panels 36, 38, 40 and 48 are folded with respect to one another into a rectangular section tubular form and the tabs 52 and 54 are secured by adhesive to the inner surface of end panel 40. Part of tab 52 is visible in FIG. 1.

Figure 2:
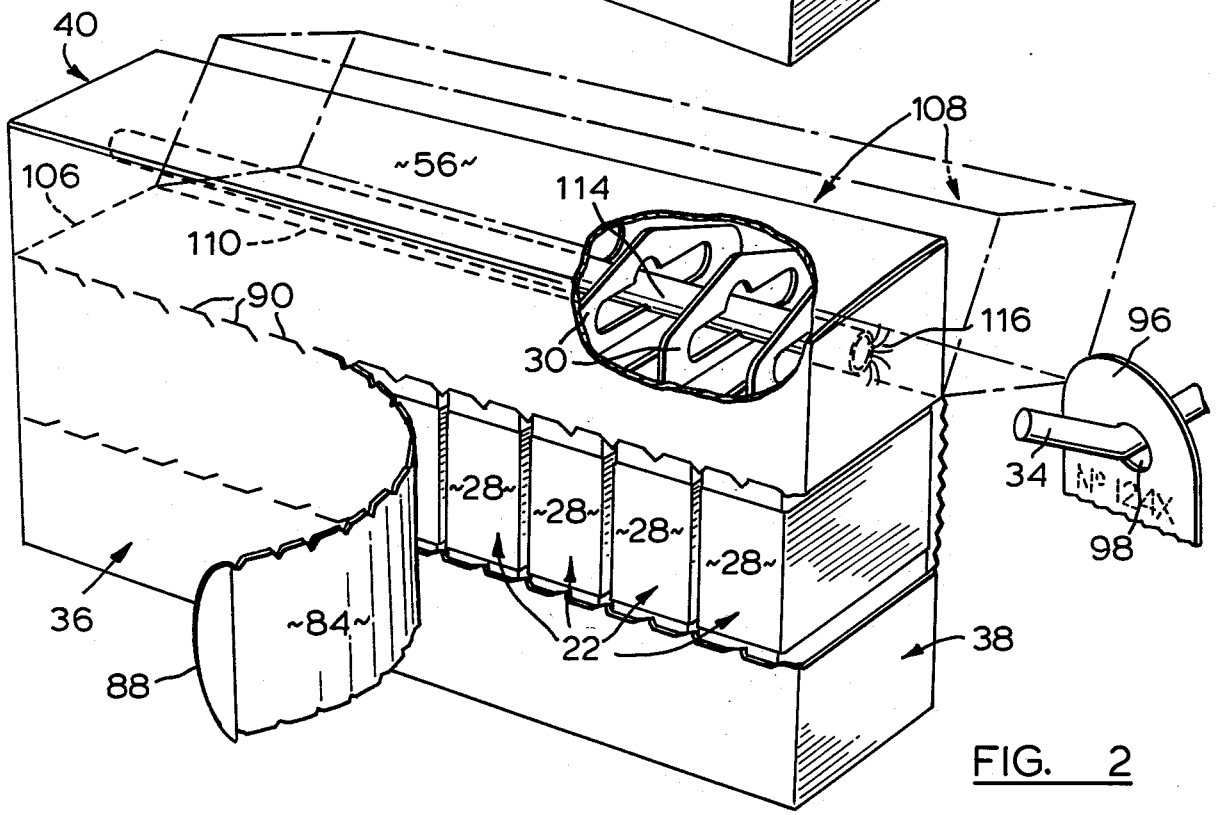
FIG. 2 is a very similar to FIG. 1 showing the cartridge at a stage preparatory to loading of the packages onto a display rack.

Referring back to FIG. 4, a further rectangular panel 56 adjoins an upper edge of panel 48 at a fold line 58 and forms a top wall or lid of the carton. Panel 56 has along its outer edge, a flap 60 which is foldable about a fold line 62 so that the flap can be tucked in behind the front wall of the carton when panel 56 is in its closed condition as shown in FIG. 2. End flaps 64 and 66 are provided at the upper edges of panels 38 and 40 respectively and are folded inwardly below panel 56 at this time. Flaps 64 and 66 adjoin the respective end panels 38 and 40 at fold lines 68 and 70 respectively (FIG. 4).

Interlocking flaps 72 and 74 are provided along the lower edges of the respective front and rear panels 36 and 48 and co-operate with end flaps 76 and 78 at the lower edges of end panels 38 and 40 to form a bottom wall of the carton. When the panels 36, 38, 40 and 48 are in the rectangular configuration they assume in the assembled carton as shown in FIGS. 1 and 2, the bottom wall is formed by first folding up flap 72 so that it extends generally normal to the front wall 36. Next, the end flaps 76 and 78 are folded inwardly and their projecting outer end portions **76*a* and 78*a* respectively are engaged in recesses 72*a* in flap 72 so that the end flaps adopt the positions shown in ghost outline at 76' and 78' respectively. Finally, flap 74 is folded inwardly and its tabs 74*a* are engaged through the respective recesses 72*a* of flap 72** to complete the bottom wall.

It will be appreciated that the carton construction described has the adanvantage that cartons can be partly assembled by securing the tabs 52 and 54 of each carton to the end wall 40 while leaving the bottom flaps 72, 74, 76 and 78 in their unfolded positions. For ease of storage and transportation, the cartons can be flattened, bringing panels 36 and 48 into surface contact. Subsequently, each carton can be assembled by displacing the panels 36, 38, 40 and 48 into a rectangular configuration and assembling the bottom flaps 72, 74, 76 and 78 as described above.

The panel 36 which defines the front wall of the carton 20 is formed with upper and lower rows of perforations 80 and 82 respectively which extend from end to end of the panel and which define a removable tear-strip 84. The end of tear-strip 84 adjacent panel 40 is defined by perforations 86 which extend along part of the fold line 44 between panels 36 and 40. The opposite end of tear-strip 84 includes a rounded pull-tab 88 cut from end panel 38. As can be seen from FIG. 1, this tab lies in a common plane with end panel 38 in the assembled carton but can be grasped and pulled outwardly to remove the tear-strip as shown in FIG. 2. In this connection, it will be noted that the lines of perforations 80 and 82 are formed by respective series of angled cuts denoted individually by the reference numeral 90 in FIGS. 1, 2 and 4. These cuts are specially designed to ensure clean separation of the tear-strip from the remainder of the front panel.

End panel 38 is performed to define not only tab 88, but also two parallel cut edges 92 and 94 (FIG. 4) aligned with the respective rows of perforations 80 and 82, and a further tab 96 having a generally semi-circular outer end portion formed with a circular aperture 98. Tab 96 adjoins panel 48 at a line of perforations 100 so that the tab is removable for the purpose to be described. The areas 102 and 104 between the two tabs are open.

The other end panel 40 of the blank is formed with a single transverse line of perforations 106 which is aligned with the upper line of perforations 80 of the front panel 36. Accordingly, in the assembled carton as shown in FIG. 2, the top portion 108 of the carton above the lines of perforations 80 and 106 and cut edge 92 can be folded back about a line 110 extending transversely of the rear wall 48 of the carton after removal of the tear-strip 84; the folded back position of top portion 108 is indicated in chain dotted outline. Fold line 110 is defined by a series of spaced aligned slits 112 arranged both to ensure that the rear wall folds accurately, and to prevent the top portion 108 of the carton from becoming completely detached from the remainder of the carton and possibly causing a waste problem.

To facilitate loading of the packages 22 onto the suspension element 34 of a display rack, a thin walled tubular plastic member, similar to a drinking straw, is inserted through the openings 32 in the hanging tabs 30 of the packages inside the carton. Part of one end of this member is visible at 114 in FIG. 1 prior to insertion into the package and the member is shown in its inserted position in FIG. 2. Member 114 is inserted into the carton through a star-shaped perforation 116 positioned in end wall 38 in alignment with the openings 32 in the package hanging tabs. After the member has been inserted through perforation 116, the portions of the end wall in which the perforation is formed tend to return naturally torwards their flat positions and partly close off the opening in the carton, thereby preventing the member accidentally leaving the carton. Member 114 is dimensioned to fit easily within the hanging tab openings 32 of the packages and so that it can be fitted over one end of a display rack suspension element for loading of the packages onto the element as will be described.

It is intended that complete cartridges containing the packages 22 will be made available to stores by the manufacturer or distributor of the packages. The cartons 20 will be delivered to or produced by the manufacturer or distributor and will be erected and loaded with packages prior to shipment to stores. As shown in FIG. 1, the packages are loaded in a row with their hanging tabs aligned with one another. Tubular member 114 is then inserted through perforation 116 to the position in which it is shown in FIG. 2. Next, the flaps 64 and 66 are closed and the top wall flap 56 folded down and its flap 60 tucked in behind the front wall 36. The carton will be appropriately marked to indicate the contents of the cartridge and will normally carry information such as the manufacturer's name, trade marks, etc. Also, the removable tab 96 in end wall 38 will be marked to indicate the contents of the cartridge, for example, by means of a re-order number. It will be appreciated that the cartridge is designated so that it can be readily shipped and stored with other similar cartridges with minimum wasted space. When the packages are to be offered for sale, the tear-strip 84 is removed by grasping the tab 88 and pulling the strip outwardly as shown in FIG. 2. The detached strip is then torn from the remainder of the box along perforated line 86 (FIG. 4) and the tear-strip is discarded. The packages are thereby exposed along one side and can be individually marked, e.g. with adhesive price labels.

Figure 3:
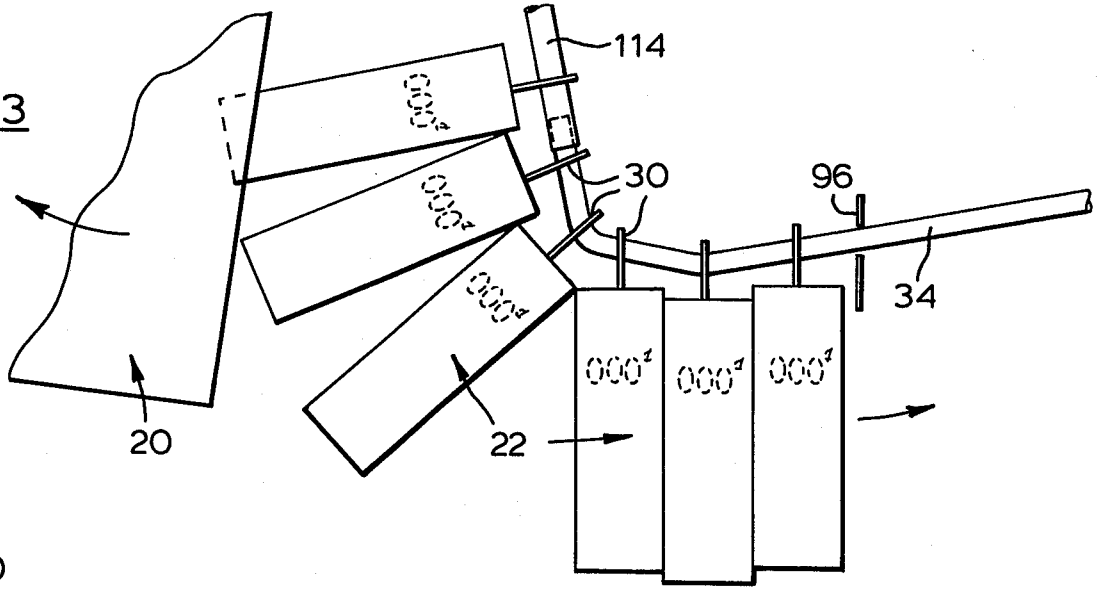
FIG. 3 is a side view of part of a display rack and illustrates loading of packages from the cartridge onto the rack; and, FIG. 4 illustrates the blank used to produce the carton of the cartridge shown in the previous views.

Prior to loading the packages onto the suspension element 34 of a display rack, the tab 96 marked with the re-order number of the product is detached and fitted onto the suspension element 34. Next, the top portion 108 of the carton is folded back about the transverse line 110 of the rear wall of the carton by tearing along the perforated line 106 (FIGS. 2 and 4) of end wall 40 to bring the top portion 108 to the folded back position in which it appears in chain line in FIG. 2. This exposes the hanging tabs of the packages 22 and the tubular member 114. The cartridge is then brought into a position in which an end of member 114 can be engaged over the outer end of the suspension element 34 as shown in FIG. 3. If the opposite end of the member is supported while the carton is withdrawn from the packages as indicated by the arrow in FIG. 3, the packages can slide freely down the member onto element 34. The carton is then discarded. When all of the packages have moved onto the suspension element, the tubular member 114 is removed and is itself discarded. The packages are then exposed for sale. When the supply of packages is exhausted, tab 96 remains on the suspension element and indicates to store personnel the type of packages to be re-ordered.

To summarize, the cartridge of the invention allows rapid batch loading of packages onto display racks. Also, the cartridge makes for convenient storage and handling of packages of hardware articles in batches prior to sale and allows the packages to be individually priced or otherwise marked.

It will be appreciated that the preceding description relates to a specific embodiment and that many modifications are possible within the broad scope of the invention. For example, while the description relates specifically to packages of hardware articles, there is no limitation in this. The packages themselves need not be of the specific form shown. Also, it is not essential to use a tubular member (as member 114) for guiding the packages onto a display rack suspension element. The packages could be successively guided onto the element by manipulating the cartridge. Also, it should be noted that the carton need not be of the specific form shown. For example, instead of providing a carton with interlocking tabs to form the bottom wall, the bottom wall could be formed by a flap similar to that used to form the top wall. Also, the carton could be made from a blank comprising a plurality of panels defined by fold lines extending transversely of the blank and foldable with respect to one another to form a carton in a manner somewhat reminiscent of the normal method of making envelopes. In any event, variations in the manner of manufacture of the carton will be apparent to a person skilled in the box-making art. It is also to be noted that the terms "front" and "rear" as applied to opposite walls of the carton are used merely for convenience of description; in practice the wall formed with the tear-strip might be considered as the rear wall of the carton.

What I claim is:

1. A cartridge comprising:

a carton;

a plurality of similar packages of hardware and like articles disposed in said carton, each said package comprising a container having a hanging tab which is formed with an opening and by which the container can be suspended from a suspension element of a display rack in use;

the carton including front and rear walls, opposite end walls, and top and bottom walls which together define an enclosure, said packages being arranged in a row in said enclosure with the openings in their hanging tabs aligned with one another and with said end walls of the carton, said front wall of the carton being formed with upper and lower rows of perforations which extend from end to end of said front wall and which define a removable tear-strip, and each said end wall of the carton being perforated to allow an upper portion of the carton to be folded back about a line extending transversely of said back wall after removal of said tear-strip, thereby exposing the hanging tabs of the packages in the carton and permitting the packages to be loaded seriatim as a batch onto a suspension element of a display rack;

and an elongate member disposed in said carton and passing through the openings in the package hanging tabs, the member being in the form of a thin walled tube dimensioned to permit an end thereof to be engaged over an end of a display rack suspension element prior to loading of packages onto said element, so that the tubular member acts as a guide along which the packages can slide onto the suspension element;

one of said end walls of the carton being formed with a star-shaped perforation aligned with said openings in the package hanging tabs and through which said tubular member can be inserted into the carton after loading of the packages during assembly of the cartridge, whereby the portions of the carton defining said star-shaped perforation tend to return to their original positions after insertion of the member, and prevent the member leaving the carton.

2. A cartridge as claimed in claim 1, wherein the top wall of the carton is defined by a panel which is coupled to said rear wall of the carton at a fold line so that the carton can be opened for loading of packages by raising said panel, and wherein the panel has at its side remote from said fold line, a flap which can be inserted behind said front wall of the carton wherein the panel is in its closed position.

3. A cartridge as claimed in claim 2, wherein said front, rear and opposite end walls of the carton are coupled to one another at fold lines so as to define a rectangular configuration when the carton is assembled, and wherein said bottom wall of the carton is defined by interlocking flaps, whereby the carton can be stored in a flattened condition with said interlocking flaps and said top wall flap open prior to assembly of the cartridge.

4. A cartridge as claimed in claim 1, wherein one of said end walls of the carton is perforated by a line of perforations which extends from said upper line of perforations in the front wall, to the back wall of the carton, and wherein the opposite end wall of the carton is perforated to define a first pull-tab forming part of said tear-strip, and a removable tab which is adapted to be engaged with a suspension element of a display rack and which is marked to identify the packages contained in the cartridge.

5. A cartridge as claimed in claim 1, wherein said line extending transversely of the back wall of the carton is defined by a series of spaced, aligned slits arranged to ensure that the back wall folds accurately about said line when the upper portion of the carton is folded back, while preventing detachment of said upper portion of the carton from the remainder thereof.

6. A cartridge as claimed in claim 1, wherein each of said upper and lower rows of perforations in the front wall of the carton is defined by a series of perforations, each of which includes an inwardly directed angled portion arranged to ensure that the tear-strip separates cleanly from the remainder of the carton.

7. A cartridge comprising:

a carton;

a plurality of similar packages of hardware and like articles disposed in said carton, each said package comprising a container having a hanging tab which is formed with an opening and by which the container can be suspended from a suspension element of a display rack in use;

the carton including front and rear walls, opposite end walls, and top and bottom walls which together define an enclosure, said packages being arranged in a row in said enclosure with the openings in their hanging tabs aligned with one another and with said end walls of the carton, said front wall of the carton being formed with upper and lower rows of perforations which extend from end to end of said front wall and which define a removable tear-strip, and each said end wall of the carton being perforated to allow an upper portion of the carton to be folded back about a line extending transversely of said back wall after removal of said tear-strip, thereby exposing the handing tabs of the packages in the carton and permitting the packages to be loaded seriatim as a batch onto a suspension element of a display rack;

and an elongate member disposed in said carton and passing through the openings in the package hanging tabs, the member being in the form of a thin walled tube dimensioned to permit an end thereof to be engaged over an end of a display rack suspension element prior to loading of packages onto said element, so that the tubular member acts as a guide along which the packages can slide onto the suspension element.

* * * * *